United States Patent [19]

Payne

[11] 4,309,150

[45] Jan. 5, 1982

[54] PERISTALTIC MOTORS

[76] Inventor: Barrett M. M. Payne, 21 Portland Dr., Umhlanga Rocks, Natal, South Africa

[21] Appl. No.: 93,773

[22] Filed: Nov. 13, 1979

[30] Foreign Application Priority Data

Oct. 20, 1978 [ZA] South Africa ..... 78/5923

[51] Int. Cl.[3] ..... F04B 9/10; F04B 35/02

[52] U.S. Cl. ..... 417/229; 417/363; 60/571; 60/579; 246/271; 92/92

[58] Field of Search ..... 417/229, 231, 383; 92/92; 60/567, 571, 579, 581; 246/116, 257, 221

[56] References Cited

U.S. PATENT DOCUMENTS

| | | | |
|---|---|---|---|
| 212,038 | 2/1879 | Molera et al. | 60/571 X |
| 792,839 | 6/1905 | Neathery et al. | 417/229 |
| 2,333,614 | 11/1943 | Boyd | 417/229 |
| 3,090,401 | 5/1963 | Hanley | 92/92 |
| 3,985,064 | 10/1976 | Johnson | 92/92 X |
| 4,004,422 | 1/1977 | LeVan | 417/229 X |
| 4,212,598 | 7/1980 | Reche et al. | 417/229 |

*Primary Examiner*—Richard E. Gluck
*Attorney, Agent, or Firm*—Ladas & Parry

[57] ABSTRACT

A peristaltic motor is provided comprising a reciprocating slave piston adapted to be actuated by the progressive, sequential contraction of two aligned, resiliently deformable peristaltic tubes by a weighted roller such as a wheel of a heavy vehicle. The leading ends of both tubes, that is the ends first contacted by the moving roller, are connected to the slave cylinder, one on either side of the piston and the trailing ends of the tubes are connected to one another so that movement of the roller from the leading end to the trailing end of the first tube causes the hydraulic fluid therein to move down the tube and into the slave cylinder moving the piston through half a stroke. Movement of the roller in the same direction over the second tube, forces the hydraulic fluid into the other side of the slave cylinder to move the piston through the second half of the stroke. The piston is associated with means to utilize its movement such as an air compressor or a pump.

4 Claims, 4 Drawing Figures

PUMP
50
12b
9b
46
44
43
40
41
9a
42
12a 18
19
14
2
2

16
10
17
9
12
24
22
20
25

10
19
32
30
24
26
28
51
18
16
10
12
14

PERISTALTIC MOTORS

FIELD OF THE INVENTION

This invention relates to a prime mover or a motor for a pump.

BACKGROUND TO THE INVENTION

A number of peristaltic pumps are available in which one or more expansible chambers are elastically deformed to provide the pumping pressure, but as far as the present applicant is aware peristaltic motors are not commonly known. A U.S. Patent search revealed U.S. Pat. Nos. 2,864,341 (Novak) and 3,985,064 (Johnson), the patent to Novak being the only true peristaltic motor of the two. In this motor fluid pressure is supplied by a pump and a four way valve is used to route the fluid to either of the ends of a peristaltic tube. The tube is located in a shell; in which a traveller is arranged to pinch the tube shut so that a fluid pressure applied to the one side of the tube will force the traveller to move in the opposite direction. The motor is reversible to become a pump although it will be appreciated that an external source of power will be required to operate the four way valve.

Two further references were located, namely U.S. Pat. Nos. 2,334,383 (Carr et al) and 4,074,531 (Menini). However, while both of these patents disclose a reciprocatory slave piston actuated by the contraction of two or more expansible chambers sequentially, neither of them shows an elastically deformable chamber in the manner of a peristaltic chamber.

SUMMARY OF THE INVENTION

According to the invention a prime mover comprises first and second, resiliently deformable compression chambers which are arranged to be progressively deformed by a weighted roller movable thereover in a given direction, a piston located in the bore of a cylinder, a fluid line connecting the respective ends of the first and second chambers, respectively, corresponding to the end of travel of the roller in each chamber in said given direction, the other ends of the chambers being connected to the cylinder by means of fluid lines leading one to each side of the piston which is associated with means to utilise its movement. It will be evident that the prime mover is a motor or like device to provide power.

The compression chambers may be peristaltic tubes and the piston may be associated with a pump, the prime mover, in the preferred form of the invention being the motor for a pump.

In the preferred form of the invention, the roller is a wheel, the pressure of the wheel moving over the length of the first tube causing hydraulic fluid pressure so generated in that tube to be transmitted to the cylinder on one side of the piston and hydraulic pressure generated in the second tube when the wheel passes over the length of that tube to be transmitted to the opposite side of the piston thereby moving the piston.

BRIEF DESCRIPTION OF THE DRAWINGS

An embodiment of the invention will now be described with reference to the drawings in which.

DETAILED DESCRIPTION OF THE PREFERRED EMBODIMENT

Figures 1, 2, 3, 4:
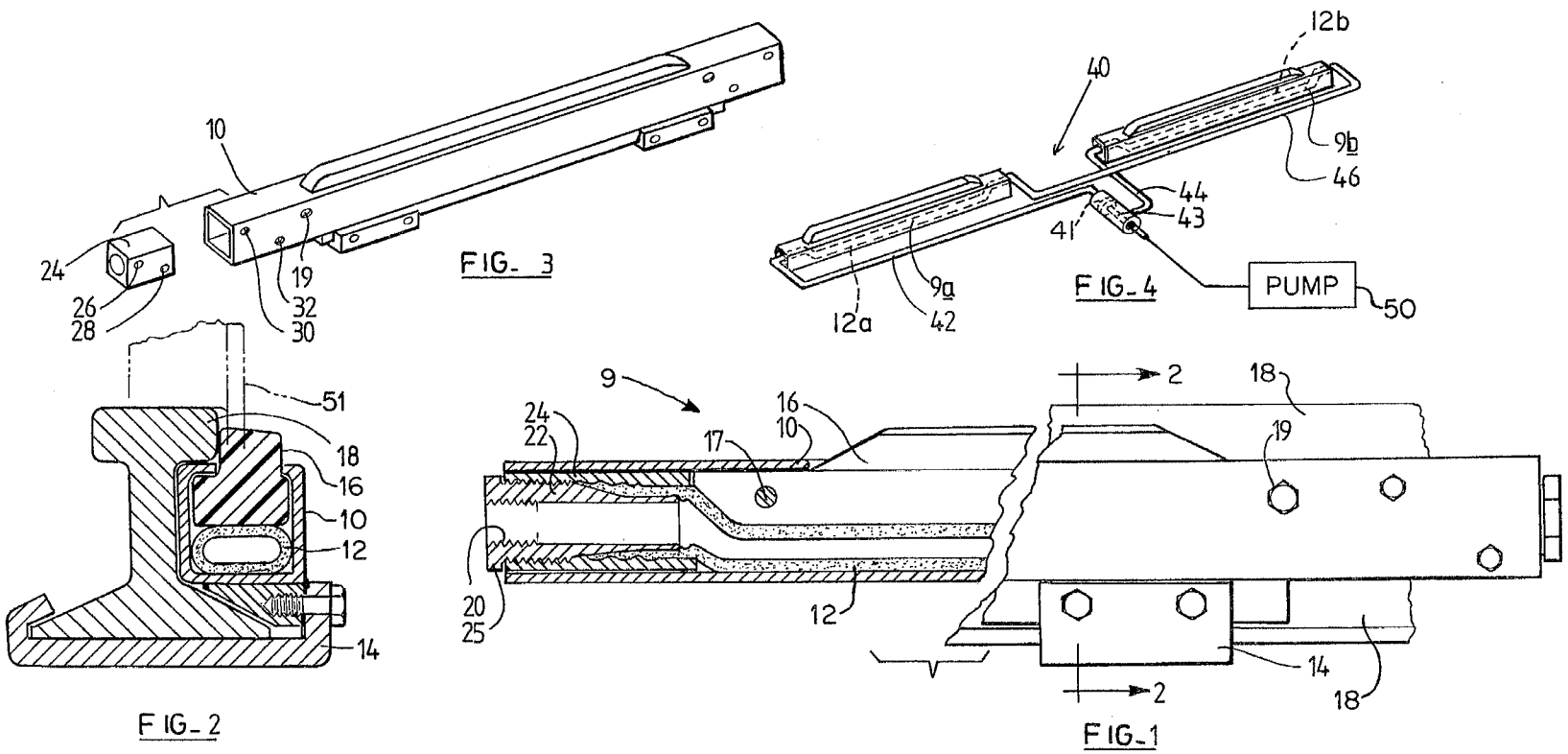
FIG. 1 is a sectional side elevation of a major component of the motor of the invention.
FIG. 2 is a sectional end elevation of the component of FIG. 1 bolted to a rail and engaged by a rail vehicle wheel as seen in the direction of the line 2—2 in FIG. 1.
FIG. 3 is a perspective view from above of the component of FIG. 1.
FIG. 4 is a perspective view from above, of two of the components of FIG. 1 illustrating the connection of the various components of the motor.

A component 9 of the motor of the invention is shown in FIG. 1 of the drawings to include a housing 10, a peristaltic tube 12 and an actuator member 16. The cross sectional shape of the pump components illustrated in FIG. 1 are more clearly seen in FIG. 2 where the housing 10 is shown bolted to a bracket 14 which secures the housing 10 to a rail 18 of the railway track.

The housing 10 is hollow, consisting of a section of a square tubing and the tube and actuator 16 are located in the bore thereof. The length of the pump component illustrated in FIG. 1 is such that the actuator 16 may be traversed by only one wheel of a rail vehicle at a time. The width of the actuator 16 is such that it will always be engaged by a rim of a rail vehicle wheel regardless of the degree of wander of the wheel on the rail 18.

The actuator 16 is moulded from polyurethane or like resilient material. The upper surface of the actuator slants downwardly away from the point where it contacts the rail to compensate for the taper on the rims of train wheels. It has been found that the train wheels passing over the actuator 16 continuously deposit metal flakes and slivers on the upper surface of the actuator. These metal particles tend to get impregnated in the polyurethane and conveniently form a hard surface. The actuator 16 is formed with an aperture 17 on either end by means of which it can be secured to the housing 10 through the apertures 19.

The tube 12 is a resilient high pressure hydraulic tube preferably of neoprene with a nylon or rayon wall reinforcing. Both ends of the tube 12 are terminated in a hose fitting at their entrances and exits to the housing 10. The hose fittings include nipples 20 for connection to hydraulic lines as is illustrated in FIG. 4. The fitting comprises threaded male 22 and female members 24. To attach the tube 12 to the fitting, the tube 12 is inserted into the female member 24, the spigot of the male member 22 is inserted into the bore of the tube 12 and the two members 22,24 are screwed into one another to clamp the tube 12 between them. The male member 22 is provided with a hexagonal head 25 to enable the two members to be screwed tightly together. The female member 24 is machined to fit within the bore of the housing 10 and it is formed with two threaded apertures 26,28 corresponding to the two apertures 30,32 on the housing 10 by means of which it can be secured to the housing with bolts or screws.

In FIG. 4 a motor assembly 40 is shown comprising two components 9*a* and 9*b* and a reciprocating slave piston 41 located in the bore of a slave cylinder 43.

A hydraulic line 42 connects the outer end of the tube 12 of the one component 9*a* into the cylinder 43 on one side of the piston 41 and a second line 44 connects the inner end of the tube 12 of the other component 9*b* into the cylinder 43 on the other side of the piston 41. A third hydraulic line 46 joins the inner end of the tube 12 of the one component 9*a* to the outer end of the tube 12 of the second component 9*b*. For the sake of clarity the tubes 12 in the first (9*a*) and second (9*b*) components will be referred to as tubes 12*a* and 12*b* respectively.

In use, the pump is located adjacent a railway track as illustrated in FIG. 2 with the actuator 16 against and just below the inner surface of the tread of the rail. The hydraulic lines 42,44,46 are connected as shown in FIG. 4 to the piston and cylinder assembly. The entire system is then filled with slightly pressurized hydraulic fluid. The motor as described above is a prime mover for a liquid pump 50 which is connected to the piston rod 41. The pump 50 is shown only schematically and may be of any conventional construction. The pump 50 is adapted to pump water from a well, borehole, river or any other water impoundment adjacent the rails to a high level reservoir from which the water may be drawn for irrigation or any other purpose as required. The motor is also suitable to provide the motive power for a compressor in a railway shunting yard. The motor 40 of the invention has been found to work extremely well as a prime mover for an air compressor.

Referring to FIGS. 2 and 4, as a train wheel 51 moves from left to right across the actuators 16 of the two components 9*a* 9*b* the rim or flange on the wheel 51 will deform the actuators 16 resiliently inward at substantially only the point of contact of the flange with the actuator to compress the tube 12. The tube 12*a* will therefore be compressed from left to right in the drawing to force hydraulic fluid at increasing pressure through the line 46, the tube 12*b* and the line 44 into the cylinder 43 behind the piston. As the tube 12*a* is being evacuated of hydraulic fluid to the right in the drawing a negative pressure is created behind the moving compressed zone of the tube, in the line 42 and in the cylinder 43 in front of the piston 41. This differential pressure across the piston 41 causes it to move forward. The moving wheel 51 then, in the same manner as described above, compresses the tube 12*b* from left to right to force hydraulic fluid at positive pressure through the line 46, tube 12*a* line 42 and into the cylinder 43 in front of the piston 41 while creating a negative pressure through the line 44 in the cylinder 43 behind the piston 41. The piston 41 now moves to the right to complete the pump stroke.

To increase the pumping capacity at a particular site a plurality of the motor 40 of the invention may be arranged adjacent each other one one or both sides of the track at the pumping site.

A particular advantage to the pump motor of the invention over known pumps is that the system includes no valves or pressure accumulators and because it is a closed circuit no provision needs to be made for make-up hydraulic fluid.

The invention is not limited to the precise constructional details as herein described and the piston and cylinder arrangement could, for example, be replaced by any suitable double acting pump such as a diaphragm pump. Additionally, provided the hydraulic lines and the tubes 12*a* and 12*b* retain the connection configuration shown in FIG. 4, the tubes 12 and 14 could be arranged by a weighted wheel adapted to rotate about a point at the centre of the track.

I claim:

1. A prime mover comprising first and second, resiliently deformable compression chambers which are arranged to be progressively deformed by a weighted roller movable thereover in a given direction, a piston located in the bore of a cylinder, a fluid line connecting the respective ends of the first and second chambers, respectively corresponding to the end of travel of the roller in each chamber in said given direction, the other ends of the chambers being connected to the cylinder by means of fluid lines leading one to each side of the piston which is associated with means to utilise its movement.

2. A prime mover according to claim 1 in which the compression chambers are peristaltic tubes.

3. A prime mover according to claim 1 in which the piston is connected to a pump.

4. A prime mover according to claim 1 in which the roller is a wheel, the pressure of the wheel moving over the length of a first tube causing hydraulic fluid pressure so generated in that tube to be transmitted to the cylinder on one side of the piston and hydraulic pressure generated in a second tube when the wheel passes over the length of that tube to be transmitted to the opposite side of the piston thereby moving the piston.

* * * * *